US012566037B2

(12) United States Patent
Dentler

(10) Patent No.: US 12,566,037 B2
(45) Date of Patent: Mar. 3, 2026

(54) HUNTING OR SPORTS WEAPON WITH IMPROVED MAGAZINE ARRANGEMENT

(71) Applicant: Daniel Dentler, Leutkirch (DE)

(72) Inventor: Daniel Dentler, Leutkirch (DE)

( * ) Notice: Subject to any disclaimer, the term of this patent is extended or adjusted under 35 U.S.C. 154(b) by 0 days.

(21) Appl. No.: 18/706,802

(22) PCT Filed: Nov. 2, 2022

(86) PCT No.: PCT/EP2022/080500
§ 371 (c)(1),
(2) Date: May 2, 2024

(87) PCT Pub. No.: WO2023/078895
PCT Pub. Date: May 11, 2023

(65) Prior Publication Data

US 2025/0020425 A1 Jan. 16, 2025

(30) Foreign Application Priority Data

Nov. 5, 2021 (EP) ..... 21206685

(51) Int. Cl.

| | |
|---|---|
| ***F41A 3/66*** | (2006.01) |
| ***F41A 9/24*** | (2006.01) |
| ***F41A 9/64*** | (2006.01) |
| ***F41A 11/00*** | (2006.01) |
| ***F41A 17/38*** | (2006.01) |
| ***F41A 19/11*** | (2006.01) |
| *F41C 23/10* | (2006.01) |

(52) U.S. Cl.
CPC ..... *F41A 17/38* (2013.01); *F41A 3/66* (2013.01); *F41A 9/24* (2013.01); *F41A 9/64* (2013.01); *F41A 19/11* (2013.01); *F41C 7/12* (2013.01); *F41C 23/10* (2013.01)

(58) Field of Classification Search
CPC ..... F41A 9/24; F41A 9/28; F41A 3/18; F41A 3/20; F41A 3/16; F41A 9/64; F41A 3/66; F41C 7/12
USPC ..... 42/6, 7, 75.03, 49.01
See application file for complete search history.

(56) References Cited

U.S. PATENT DOCUMENTS 3,020,662 A * 2/1962 Merkel ..... F41A 19/39 42/69.01
10,345,074 B1 7/2019 Zamlinskiy
(Continued)

FOREIGN PATENT DOCUMENTS

DE 202004016800 U1 9/2005
DE 102006009895 B3 7/2007
(Continued)

*Primary Examiner* — Reginald S Tillman, Jr.
(74) *Attorney, Agent, or Firm* — FISHERBROYLES, LLP; Roger L. Browdy; Ronni S. Jillions

(57) ABSTRACT

A hunting or sports weapon with a handguard (4) attached to a receiver (5) and a barrel (3), wherein the barrel (3) with a cartridge chamber (34) leads into a breechblock (26) and forms a breech face (20) for the cartridge to be fired there, wherein a magazine well (24) for the introduction of a magazine (17) is arranged on or in the receiver (5), and on the receiver (5) a trigger unit (6), wherein a buttstock (11) adjoins the receiver (5), wherein the magazine (17) is arranged in a swivel unit (31) which can be swung away in a horizontal axis or in a plug unit (32) and is integrated at least partly in the buttstock (11).

15 Claims, 10 Drawing Sheets

(56) References Cited

U.S. PATENT DOCUMENTS

Figure 1:
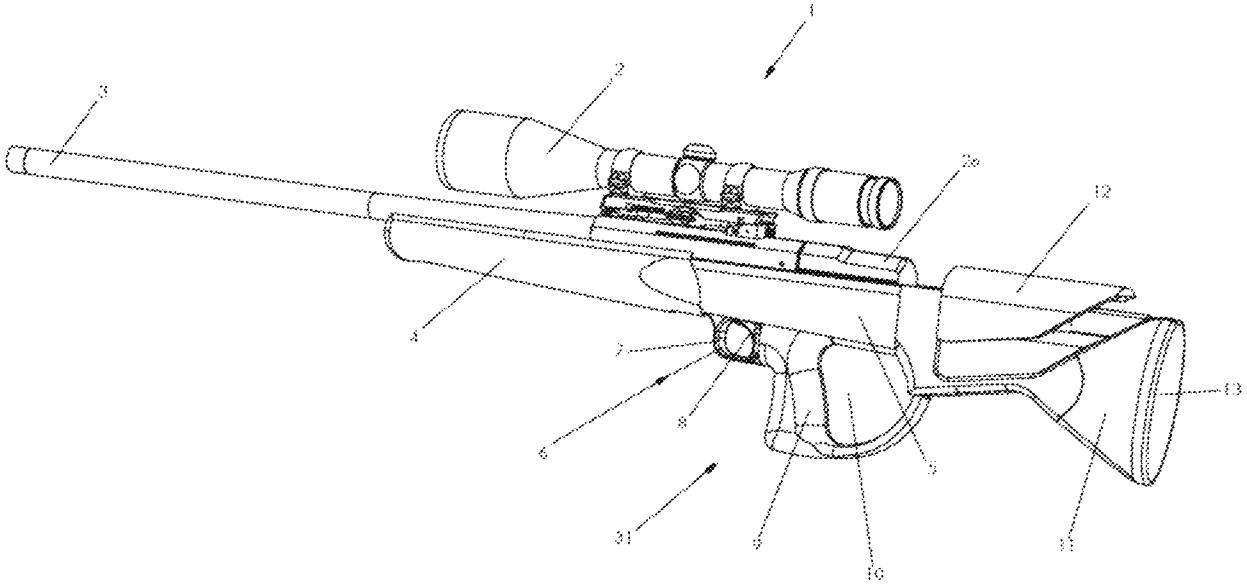

| | | | | |
|---|---|---|---|---|
| 11,940,240 | B2 * | 3/2024 | Makowski | F41A 21/48 |
| 12,092,417 | B2 * | 9/2024 | Spuhr | F41A 3/68 |
| 2015/0338181 | A1 | 11/2015 | Mcalister | |

FOREIGN PATENT DOCUMENTS

| | | | | |
|---|---|---|---|---|
| WO | WO-2020251401 | A1 * | 12/2020 | F41C 7/06 |
| WO | WO-2021049971 | A1 * | 3/2021 | F41C 7/00 |

* cited by examiner

HUNTING OR SPORTS WEAPON WITH IMPROVED MAGAZINE ARRANGEMENT

The invention relates to a hunting or sports weapon with an improved magazine arrangement according to the preamble of claim 1.

Hunting or sports weapons of the type in question are known, for example, from DE 20 2004 016 800 U1. They are also called repeating rifles and are preferably designed as multiple-shot rifles with a magazine for several cartridges. They belong to the category of handguns.

Related prior art can also be found in a PDF publication by Mauser on the M12 weapon type. See https://www-.mauser.com/fileadmin/Editoren/PDF-Downloads/Gebrauchsanleitungen-2018/MAUSER Gebrauchsanleitung M12 web.pdf.

From this it can be seen that the magazine is even housed in front of the trigger guard, which means that the weapon is longer by the length of the cartridge than the Blaser R8, in which the magazine is arranged above the trigger.

This results in the length of the system by design and the necessary length of the receiver of the weapon and leads to unmanageable weapon lengths. Therefore, the barrels are often simply shortened in order to achieve a reasonably manageable overall weapon length.

With its R8 weapon type, the company Blaser provides a hunting or sports weapon in which the buttstock and the pistol grip form a coherent, inseparable unit. However, this has the disadvantage that the magazine has to be arranged lengthwise in front of the pistol grip, i.e., towards the muzzle, which unnecessarily increases the length of the weapon.

A hunting or sports weapon of the type in question with a so-called insertion magazine is the subject of DE 10 2006 009 895 B3. The insertion magazine is characterized in that a trigger unit with a trigger guard and a firing trigger is affixed to its underside in such a way that the trigger unit can be removed from the handgun together with the insertion magazine.

A characteristic of this prior art is that the magazine together with the trigger unit forms a pluggable arrangement and is arranged directly above the trigger guard.

The disadvantage is that a quick-change magazine to change an existing magazine can only be provided with great effort, because, if the empty magazine is to be exchanged quickly with another, filled magazine, the entire unit, consisting of the trigger unit, the trigger guard together with the magazine, has to be replaced. It is therefore a costly replacement, which is also associated with considerable difficulties due to the high space requirements and the weight, in practice, i.e., when hunting.

The required plug connection between the weapon's receiver and the trigger unit is also problematic because if the plug connection is not made correctly, it is not possible to fire a shot with the weapon, even if there is a ready-to-fire cartridge in the barrel's chamber.

Since the trigger unit is not firmly connected to the weapon, there is the further disadvantage that if the entire insertion magazine with integrated trigger unit is not available, e.g., for example, forgotten to pack it before going hunting, it will not be possible to fire a shot.

Another disadvantage of the well-known insertion magazine is the undesirably long overall length of the hunting or sports weapon, due to the fact that the breech face is arranged in front of the trigger, which increases the overall length of the weapon in an unfavorable way.

By definition, the breech face is the rear limit of the breech block. This also means that the front edge of the magazine is arranged directly behind the breech face and that the two geometric dimension lines are located in front of the trigger towards the muzzle.

Since the cartridges are positioned exactly above the trigger and the trigger guard and the breech face is arranged in front of the firing trigger and the trigger guard, the length of the entire weapon is inevitably increased by the length of the cartridge, and cannot be shortened by this length because of this arrangement.

The invention is therefore based on the object of refine a hunting or sports weapon with an exchangeable magazine in such a way that the overall length of the hunting or sports weapon is shortened while maintaining the length of the barrel and the length of the buttstock.

To achieve the stated object, the invention is characterized by the technical teaching of claim 1.

A preferred feature of the invention is that the magazine is designed as an insertion magazine which can be swung away or plugged in and which is integrated in the front part of the buttstock.

The invention therefore provides for a functional separation to be arranged between the pistol grip and the buttstock. In the prior art, the pistol grip was an inseparable unit with the buttstock and, according to the invention, this unit is now separated and the pistol grip is designed independently of the buttstock, which provides the advantage that, according to the invention, the magazine can now be arranged directly above or on the pistol grip which is now arranged at the buttstock or the receiver so that it can be swiveled or it is pluggable. This results in a significant saving in the overall length of the weapon, because the length of the magazine no longer increases the overall length of the weapon, as is disadvantageously shown in the Mauser version.

The technical teaching at hand results in the further advantage that the magazine is no longer arranged directly aligning above the trigger guard—as in the prior art (Blaser), but according to the invention the magazine with its magazine well is integrated in the buttstock or in the receiver, which has the advantage that the breech face is behind the trigger and the magazine is arranged above the pistol grip and no longer aligning above the trigger guard (Blaser) or even in front of the trigger guard (Mauser).

This results in the further advantage that it is now possible for the first time to make the trigger unit separable from the pistol grip, because the magazine is arranged above the pistol grip and it is therefore possible to design the trigger unit with the trigger guard and the firing trigger to be separable from the pistol grip.

In a preferred embodiment of the present invention, however, the magazine is designed as an insertion magazine which can be swung away and is pluggable, which, in the first-mentioned alternative, has the advantage that a swivel connection is arranged in a horizontal swivel axis on the underside of the receiver between the trigger unit, consisting of the trigger guard integrated there with the firing trigger and the pistol grip.

In a kinematic reversal, however, it can also be provided that the horizontal swivel bearing of the first-mentioned alternative is not arranged in the front part of the weapon, but in the opposite direction at the rear part of the pistol grip, that is to say in the area of the front part of the buttstock.

While in the first embodiment the entire swivel magazine is swiveled forwards in order to be able to insert a new magazine from the rear, in a modified embodiment it can be provided that the entire swivel unit is swung away backwards and then the magazine is inserted into the swivel unit from the front.

The term "front" refers to the muzzle side and the term "rear" refers to the buttstock side.

In a preferred embodiment according to the invention, the difference from the prior art is that the swivel unit comprises the trigger unit, the pistol grip and the magazine affixed above the pistol grip and remains connected to the weapon via a swivel connection.

In the second variant, in which the magazine is designed as a plug unit, it is also provided that the trigger unit always remains on the weapon, whereby only the pistol grip with the magazine arranged on it is designed to be pluggable.

This eliminates the disadvantage of the prior art that the entire trigger unit has to be designed as a plug unit. A plug unit that can be completely removed from the weapon with the magazine has the disadvantage that the plug unit is heavy because it also contains the sensitive mechanics of the trigger unit, which can also jeopardize operational safety due to the risk of contamination.

However, the subject matter of the present invention is not the functional connection between the firing trigger and the breechblock in which the firing pin, the springs associated with the firing pin and similar functional parts are arranged. It is always assumed that such a functional connection exists between the firing trigger and the breechblock, but this is not part of the invention.

In summary, it can be stated that the shortened overall length of the hunting and sports weapon according to the invention is achieved by the fact that the magazine is part of the buttstock or the receiver and is arranged approximately or largely above the pistol grip.

Compared to the prior art, the magazine has been moved to the rear, to the front part of the buttstock, which is associated with a shortening of the overall length with an unshortened barrel and unshortened buttstock. This improves the handling of the hunting or sports weapon. The term "handling" refers to the ability of the weapon to be handled.

In the preferred embodiment, the entire swivel unit, consisting of the trigger unit and pistol grip with the insertion magazine integrated therein, can be swung away and swiveled forwards or backwards, while in the other embodiment the entire unit is designed as a plug unit.

When designed as a plug unit, the advantage is that, due to the magazine being moved backwards towards the buttstock, it is now possible to leave the trigger unit on the weapon and only provide the plug option on the pistol grip, thus creating a separation line between the trigger unit remaining on the weapon and the pluggable pistol grip with the plug magazine integrated there.

The subject matter of the present invention results not only from the subject matter of the individual claims, but also from the combination of the individual claims with one another.

All information and features disclosed in the documents, including the abstract, in particular the spatial configuration shown in the drawings, could be claimed as essential to the invention insofar as they are new compared to the prior art, individually or in combination.

The use of the terms "essential" or "according to the invention" or "essential to the invention" is subjective and does not imply that the features so named must necessarily be part of one or more patent claims.

Below, the invention is explained in more detail with reference to drawings which illustrate only one embodiment. Further features essential to the invention and advantages of the invention will become apparent from the drawings and their description.

Figure 2:
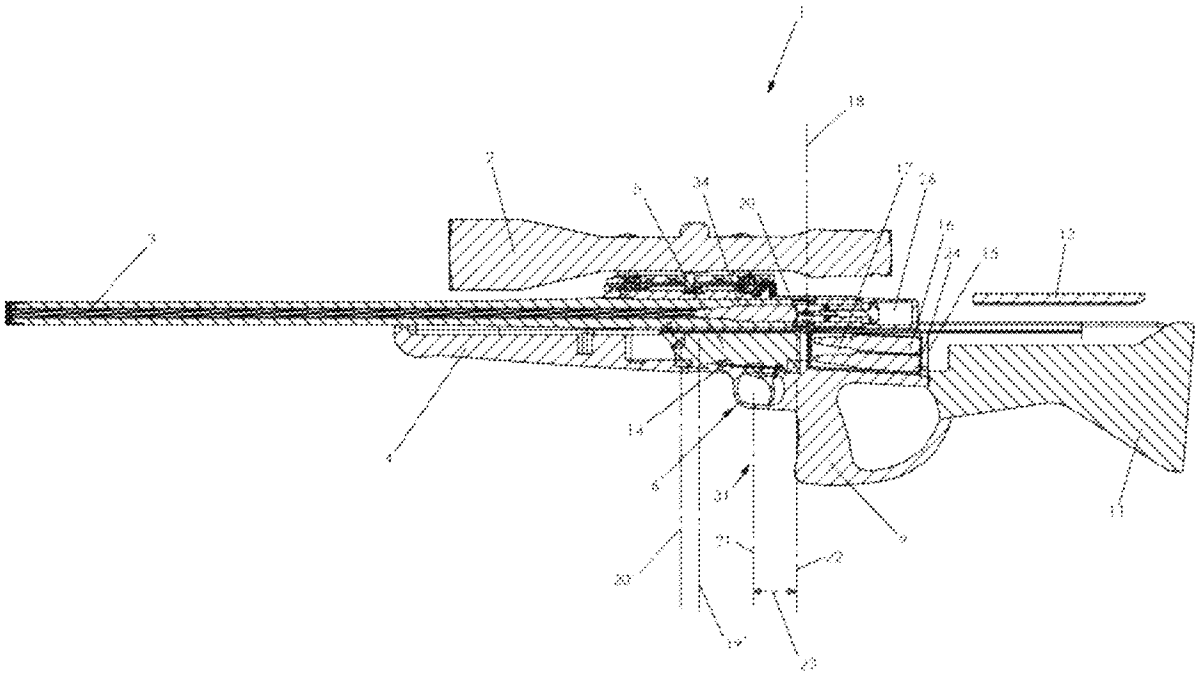

In the figures:

FIG. 1: shows a perspective view of a hunting or sports weapon in the ready-to-fire position FIG. 2: shows a section through the arrangement according to FIG. 1

Figure 3:
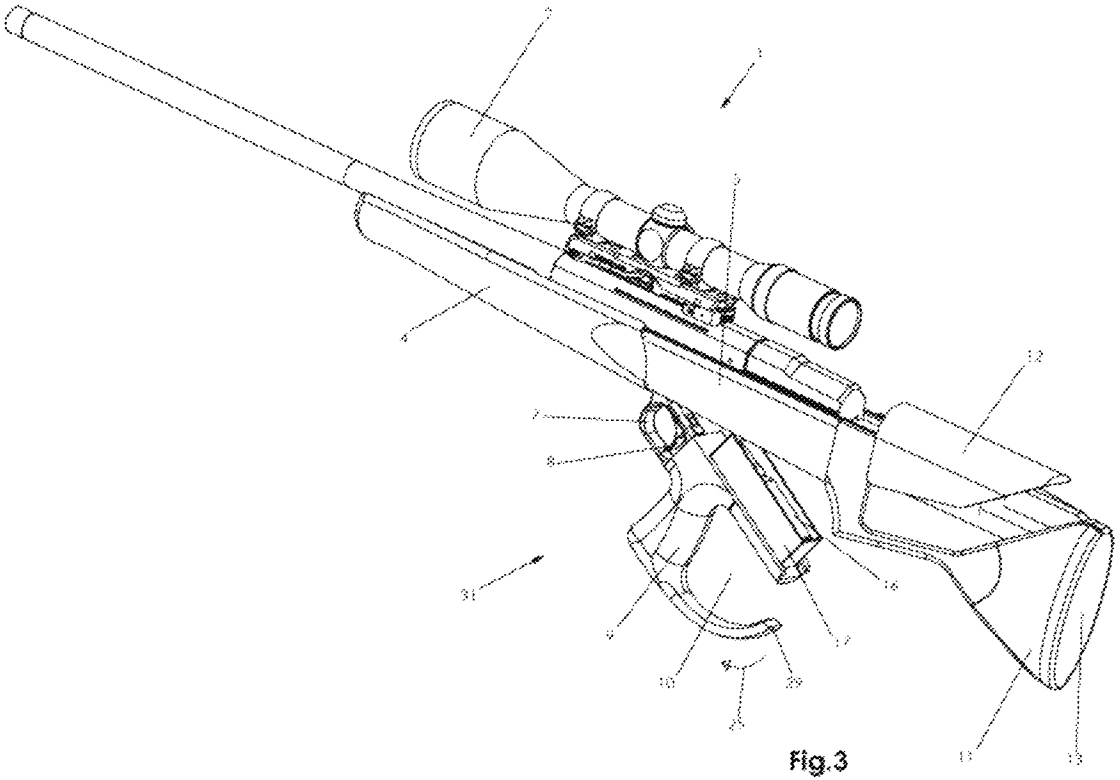
Figure 4:
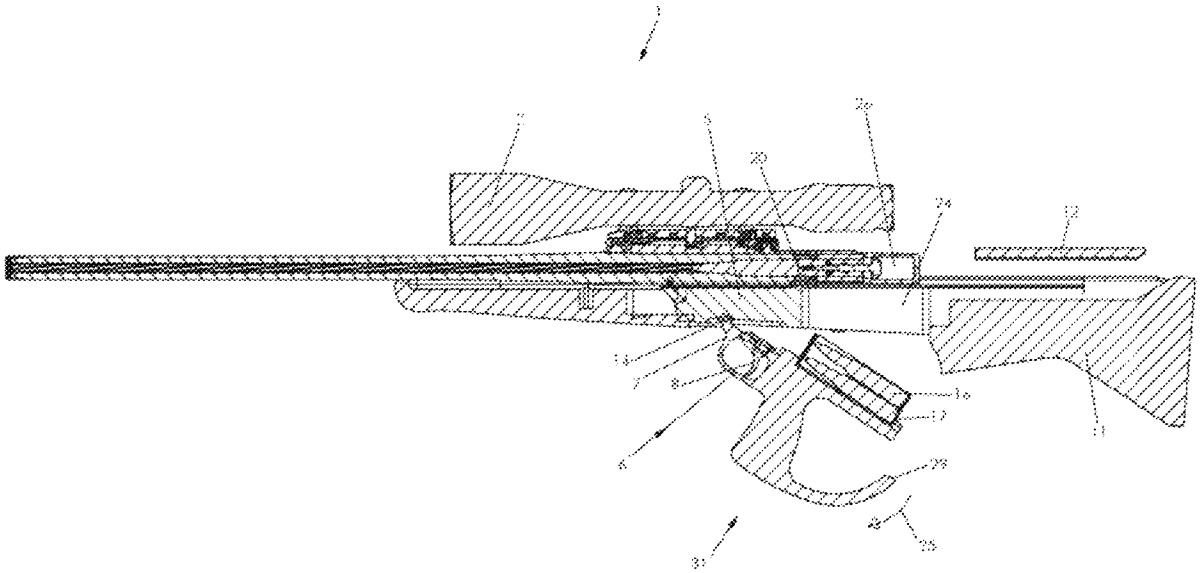

FIG. 3: shows the hunting and sports weapon according to FIGS. 1 and 2 with the swivel unit opened to the rear FIG. 4: shows the section through the arrangement according to FIG. 3

Figure 5:
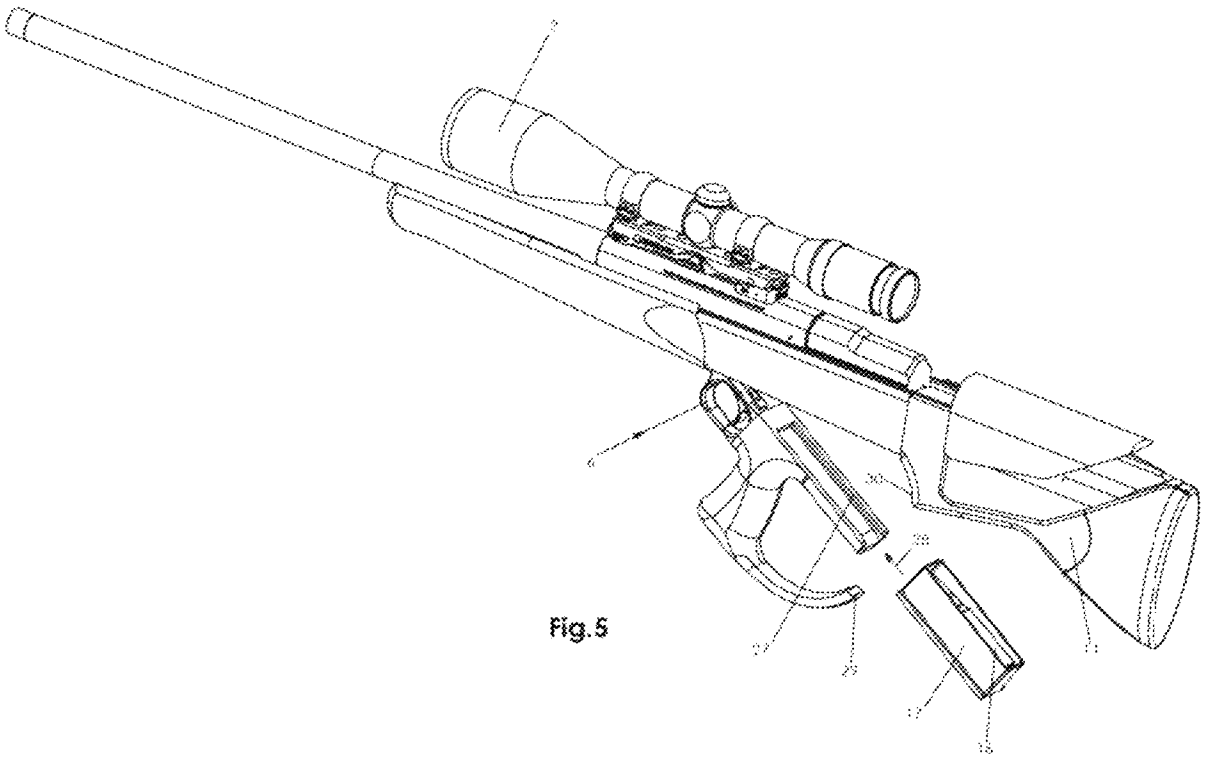
Figure 6:
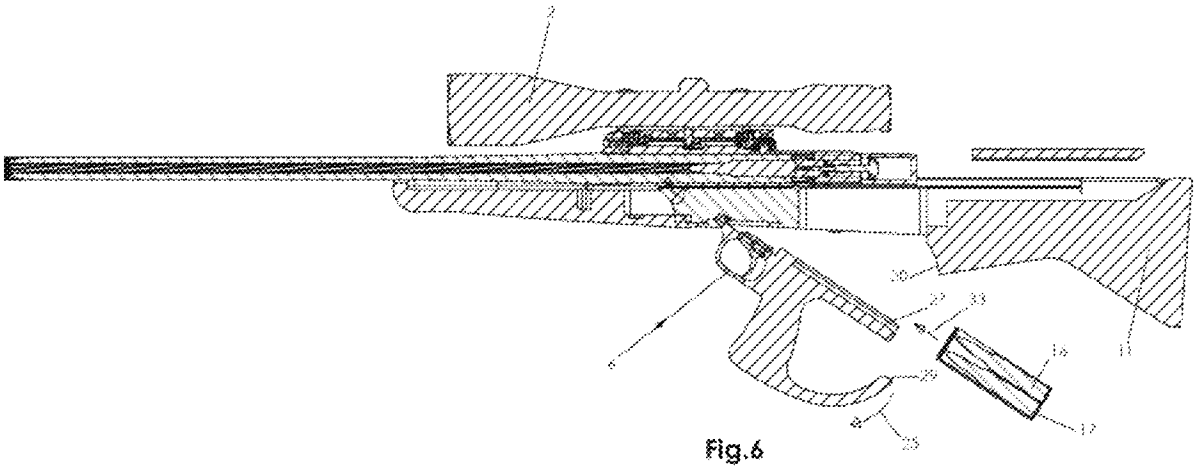

FIG. 5: shows the same representation as FIG. 3 and FIG. 4, but showing the removal of a magazine FIG. 6: shows the section according to FIG. 5

Figure 7:
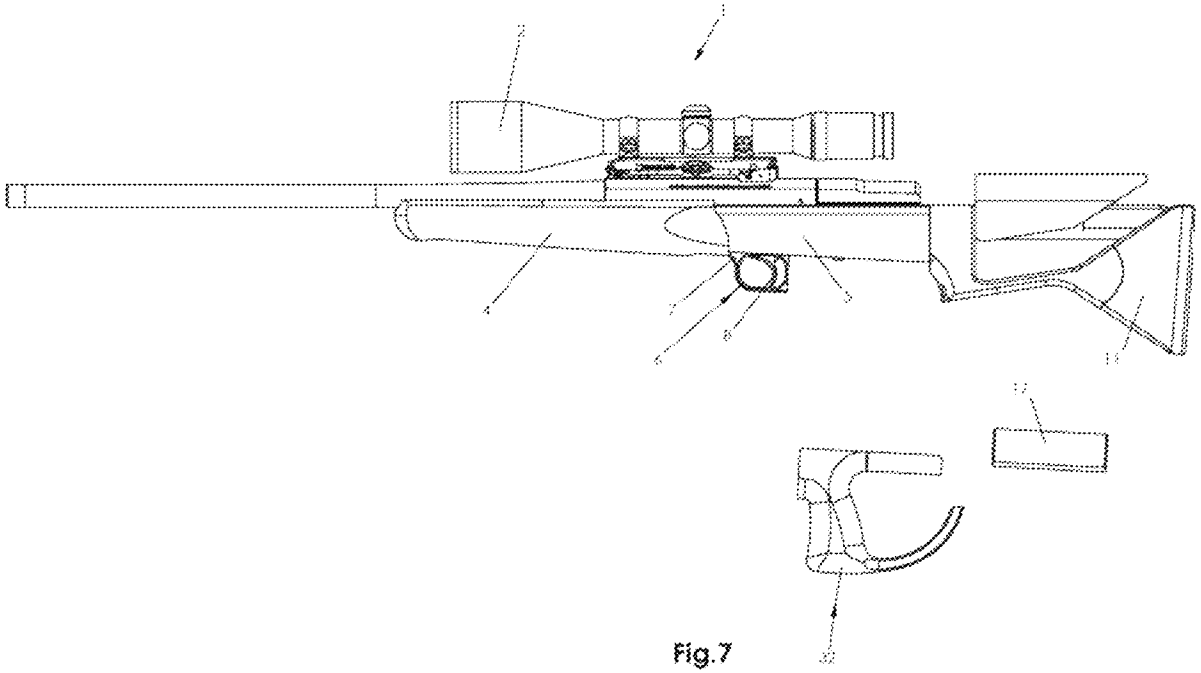
Figure 8:
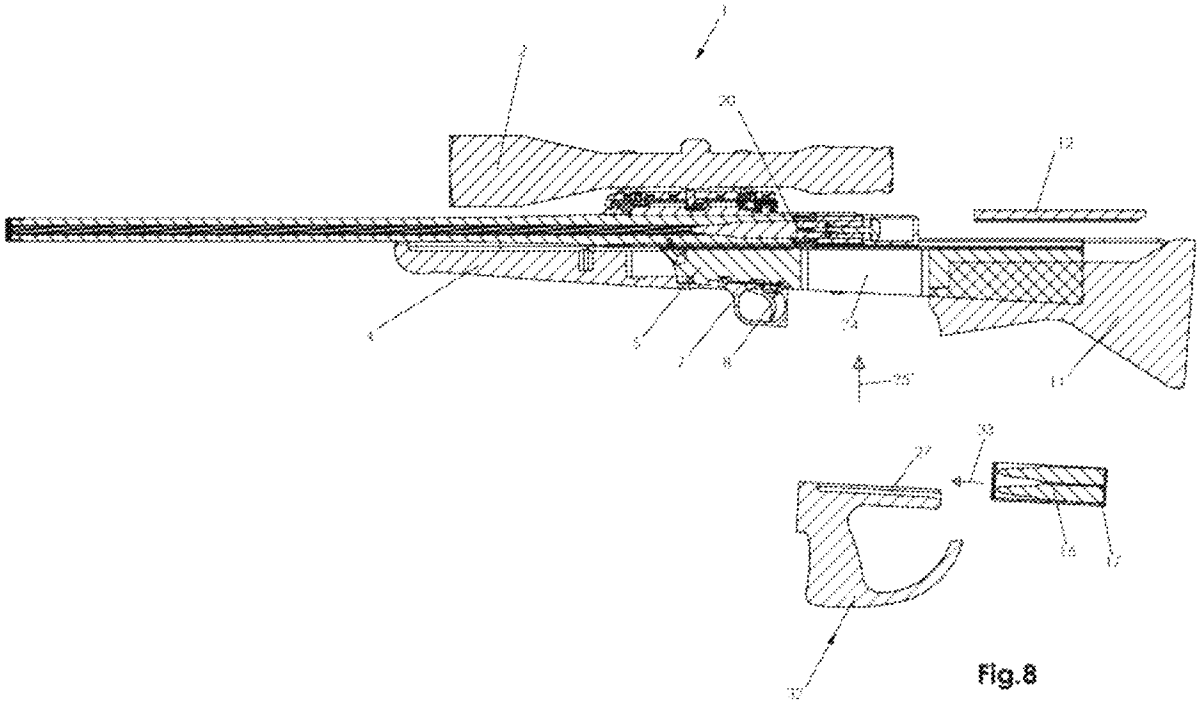

FIG. 7: shows a hunting and sports weapon with pluggable magazine in side view FIG. 8: shows a longitudinal section through the arrangement according to FIG. 7

Figure 9:
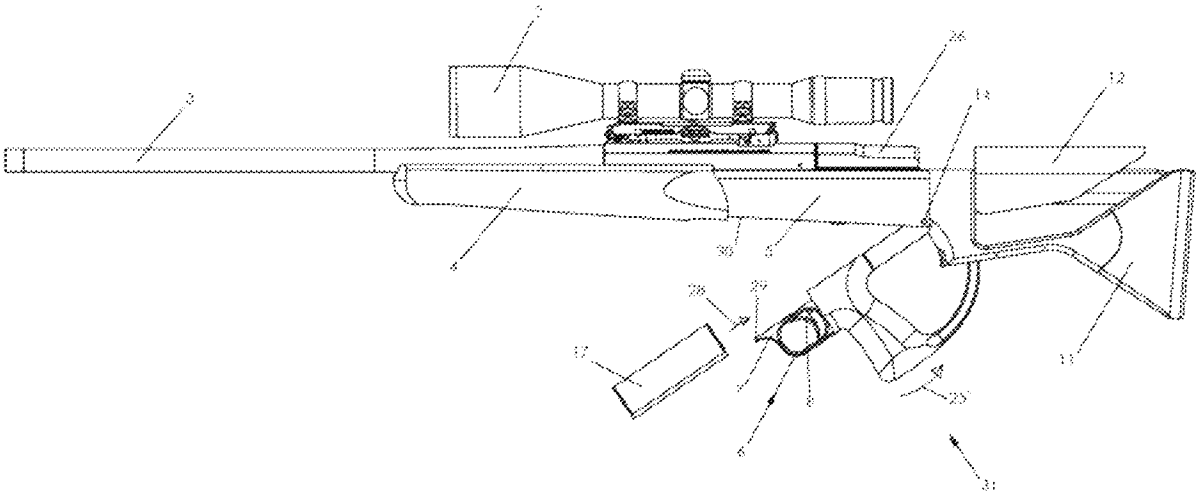
Figure 10:
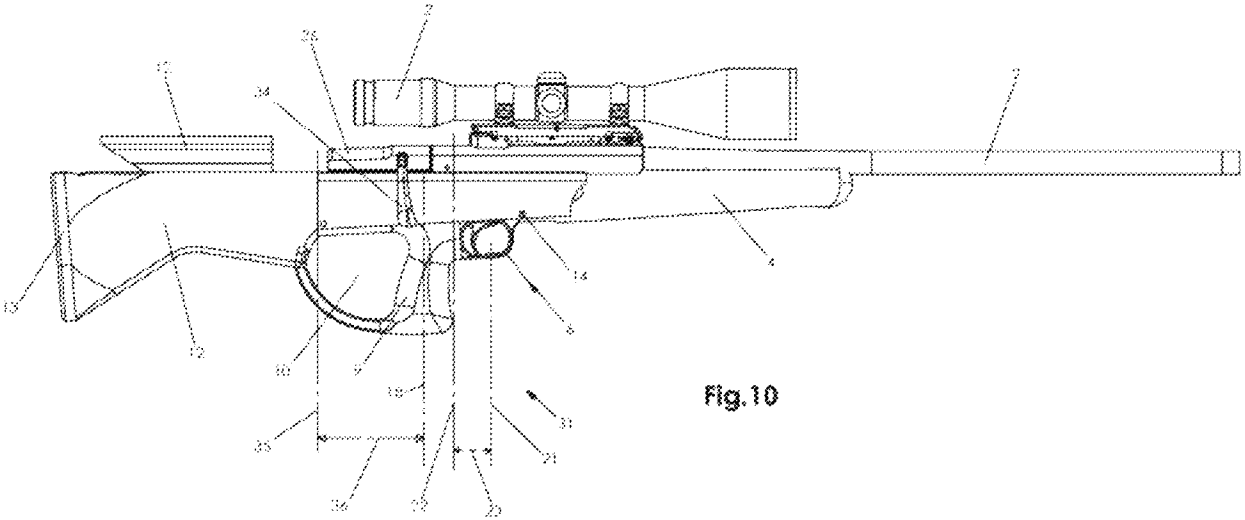

FIG. 9: shows the same representation as FIG. 6, but no sectional view, with the swivel unit opened to the front FIG. 10: shows a hunting and sports weapon from the side with the bolt handle The hunting or sports weapon 1 is connected to a gunsight 2 and consists of a barrel 3, a handguard 4 which is mounted on the adjoining receiver 5, in which the holder of the barrel 3 is affixed and in which the magazine well 24 for a magazine 17 is arranged.

In the exemplary embodiment shown, trigger unit 6 preferably consists of a trigger guard 7 in which the manually operable firing trigger 8 is arranged and also of a pistol grip 9 integrated therein, which forms a passage 10 for the firing hand in a manner known per se.

With the mentioned parts, namely trigger unit 6, consisting of trigger guard 7, firing trigger 8 and pistol grip 9, a swiveling unit 31 is formed according to the invention, which is designed to be swiveled in a front horizontal swivel bearing 14 on the front part of receiver 5 near its underside.

Buttstock 11 adjoins longitudinally behind swivel unit 31 and preferably has a comb 12 and a rear, closing butt plate 13.

Connection line 15 marks the functional separation between the front part of buttstock 11 and the rear part of receiver 5.

The invention is not limited to the exact embodiment of the hunting or sports weapon shown here. For example, it may be provided that gunsight 2 is omitted or that further additional parts can be mounted, such as, e.g., night vision devices, night aiming devices, open sights, reflex sights and the like.

In its design as a hunting or sports weapon, the invention has achieved that—in comparison to known hunting and sports weapons with comparable barrel and buttstock length and known handling and shooting precision—there is a non-shortened barrel 3 and also a non-shortened buttstock 11 in order to maintain or even improve the usability of the weapon.

According to the prior art, it is known to use a barrel length of 690 mm, for example, as the distance between the muzzle and the breech face is concerned.

This results in a total weapon length (Blaser R8) from the muzzle to the buttstock end of about 1130 mm. For a weapon that has the magazine arranged in front of the trigger guard, the total weapon length is about 1200 mm. This invention means a length saving of about 160 mm with the same barrel length and the same buttstock dimensions.

This is where the invention comes in, which now results in a shortened total weapon length of about 1040 mm while maintaining the same shooting quality, i.e., with the same barrel length of 690 mm and the same stock length.

This means that there is a total weapon length reduction of preferably about 100 mm, which leads to a shortened weapon but with the same shooting quality and—due to the shortened length—improved handling.

The difference in the total weapon length that could be saved is due to the new arrangement of the magazine, which, according to the invention, is partially integrated in the buttstock.

In a way, the total length of the cartridges is saved on the total length of the weapon because the cartridge length is now part of the buttstock and no longer increases the total length of the weapon in an undesirable way—as is the case with current prior art.

In FIG. 2, the proportions given are also to be understood in this way, where the same parts of the drawings are included with the same reference numerals.

First, it is stated that cartridges 16 are arranged in a magazine 17 and magazine front edge 18 is arranged a short distance in front of the breech face 20.

At the same time, the prior art is also shown in FIG. 2 using primed reference symbols. There, it can be seen that, in accordance with prior art according to DE 10 2006 009 895 B3, breech face 20' is moved forwards, in front of trigger unit 6, as is the magazine front edge 19'. This results in the overall length of cartridges 16 extending the overall length of the weapon in an avoidable manner, which is avoided with the invention by partially integrating cartridges 16 together with magazine 17 that holds them in buttstock 11.

Trigger center line 21 according to the invention therefore has a distance 23 in the range between 10 and 50 mm from breech face line 22 according to the invention. This means that the breech face with breech face line 22 is located behind the firing trigger and behind trigger center line 21, whereas, in the prior art according to the aforementioned DE 10 2006 009 895 B3, it is located in front of trigger center line 21, as shown in FIG. 2 in superscript reference numeral.

Further details can be seen in FIG. 3, namely the swiveled state of the swivel unit, which has been swiveled forward in the direction of arrow 25, whereby magazine well 24 is exposed.

Furthermore, it can be seen from FIGS. 3 to 6 that swiveling unit 31 has a draw-pull 27 for the insertion of a magazine 17 suitable for this purpose, the insertion direction being in the direction of arrow 28.

The invention is not limited thereto.

Instead of a longitudinally directed draw-pull 27, other fastening means can also be provided between magazine 17 and swivel unit 31. Instead of the insertion direction in the longitudinal direction of the weapon in the direction of arrow 28, a draw-pull can also be provided in the vertical direction. This means that the magazine would be positively connected to the draw-pull in the transverse direction to the draw-pull.

It is also possible for magazine 17 to be tilted or locked into the draw-pull from the side.

FIG. 9 illustrates that the swivel connection with horizontal swivel bearing 14 can also be arranged on the buttstock or on receiver 5, which means that the same swivel unit 31 cannot be swiveled forward in the direction of arrow 25, but can now be swung away forward in the opposite direction to the direction of arrow 25, i.e., in the direction of arrow 25', because swivel bearing 14 has been relocated to the buttstock.

In this case, locking receptacle 30 is moved into the area of swivel bearing 14 on handguard 4 or on receiver 5 and can be swung away forwards in the opposite direction to the direction of the arrow 25, i.e. in the direction of arrow 25', with the same reference numerals applying to the same parts.

Locking receptacle 30 shown in FIG. 5 is arranged on buttstock 11 and interacts with a locking device 29 which is arranged at the free rear end of swivel unit 31.

FIG. 10 shows the weapon side with the bolt handle 37. Trigger center line 21 according to the invention therefore has a distance 23 in the range between 10 and 50 mm from the breech face line 22 according to the invention. This means that the breech face with breech face line 22 is located behind the firing trigger and behind trigger center line 21. When the breech block is open, breech face 20 of breech block 26 reaches distance line 35 with a maximum distance 36 of about 120 mm. This means that a larger distance 23 in the range between 10 and 50 mm is not useful, due to the ergonomic handling of bolt handle 37 when repeating in the firing position.

Therefore, bolt handle 37 is preferably arranged above and at the rear end of the pistol grip, which leads to a particularly advantageous ergonomic operation.

From FIG. 10 it can be seen that bolt handle 37 is advantageously located at the rear of pistol grip 9 when breech block 26 is closed. This allows the shooter to carry out the repeating process without losing any distance or time.

However, the current prior requires unfavorable grip movements for a bolt handle arranged at the front (e.g., Blaser R8, Mauser M12, M98) or at the rear (e.g., Bullpup rifles), which results in a loss of distance or time when operating bolt handle 37.

It has been stated above that the functional connection between firing trigger 8 and breechblock 26 is not shown in detail in order to keep open various possibilities for the functional connection. This functional connection is not the subject of the invention. It should be noted that when the firing trigger 8 is pulled, a shot is fired in the breechblock 26 and barrel 3.

In FIG. 7, instead of swivel unit 31, a plug unit 32 is shown, which differs from the swivel unit in that plug unit 32 is completely removable and trigger unit 6 remains on the weapon in its entirety and is therefore not designed to be swivelable.

Only pistol grip 9 with magazine 17 is removed, which has the great advantage of a simplified design of the plug unit 32, a weight saving when using spare magazines and a simplified and more reliable operation.

In the present application, it is preferred in all embodiments that magazine 17 is arranged above the pistol grip and that trigger center line 21 and breech face line 22 are only a small distance in the range between 10 and 50 mm from front edge 18 of magazine 17.

This provides and maintains the advantage that the gas pressure generated when the shot is fired does not act on the face or shoulder of the shooter because the aforementioned parts are arranged in front of buttstock 11.

This arrangement makes it possible for the hunting and sports weapon according to the invention to retain a traditional appearance (Mauser or Blaser) despite the shortened overall length, while improving the handling of the weapon.

Another advantage of the invention is that swivel or plug unit 31, 32 with a magazine box that is open at the top also makes it possible to load magazine 17 from above with breechblock 26 open when swivel unit 31 is not swiveled away or when the plug unit 32 is inserted, without swivel unit 31 having to be opened or plug unit 32 having to be removed.

By achieving a shortened weapon length while maintaining the same barrel and stock length as the prior art, there is the additional advantage that silencers attached to the barrel do not result in the weapon being difficult to handle.

LIST OF REFERENCE NUMERALS

1 Hunting or sports weapon
2 Rifle scope
3 Barrel
4 Handguard
5 Receiver
6 Trigger unit
7 Trigger guard
8 Firing trigger
9 Pistol grip
10 Passage
11 Buttstock
12 Comb
13 Butt plate
14 Swivel bearing
15 Connecting line
16 Cartridge
17 Magazine
18 Magazine front edge
19' Magazine front edge (prior art)
20 Breech face 20' (prior art)
21 Trigger center line
22 Breach face line
23 Distance between 21 and 22
24 Magazine well
25 Arrow direction and 25'
26 Breechblock
27 Draw-pull
28 Arrow direction
29 Locking device
30 Locking receptacle
31 Swivel unit
32 Plug unit
33 Arrow direction
34 Cartridge chamber
35 Distance line
36 Distance between 35 and 18
37 Bolt handle

The invention claimed is:

1. A hunting or sports weapon with a handguard attached to a receiver and a barrel, wherein the barrel with a cartridge chamber leads into a breechblock and forms a breech face for the cartridge to be fired there, wherein a magazine well for the introduction of a magazine is arranged on or in the receiver, and on the receiver a trigger unit, wherein a buttstock adjoins the receiver, wherein the magazine is arranged in a swivel unit which can be swung away in a horizontal axis and is integrated at least partly in the buttstock, wherein the trigger unit is connected firmly to the pistol grip and is part of the swivel unit, and wherein the breech face and a magazine front edge of the magazine are arranged behind a trigger center line of the trigger at a distance in a range from 10 to 50 mm.

2. A hunting or sports weapon with a handguard attached to a receiver and a barrel, wherein the barrel with a cartridge chamber leads into a breechblock and forms a breech face for the cartridge to be fired there, wherein a magazine well for the introduction of a magazine is arranged on or in the receiver, and on the receiver a trigger unit, wherein a buttstock adjoins the receiver, wherein the magazine is arranged in a vertical axis pluggable plug unit and is integrated at least partly in the buttstock, wherein the breech face and a magazine front edge of the magazine are arranged behind a trigger center line of the trigger at a distance in a range from 10 to 50 mm, and wherein the magazine is arranged above a pluggable pistol grip and connected thereto.

3. The hunting or sports weapon according to claim 1, wherein the magazine well for receiving the magazine adjoins the rear end of the receiver and projects into the buttstock and at least partly is part of the buttstock.

4. The hunting or sports weapon according to claim 1, wherein the magazine is arranged above a pluggable or swivelable pistol grip and connected thereto.

5. The hunting or sports weapon according to claim 2, wherein the trigger unit is connected firmly to the pistol grip and is part of the plug unit.

6. The hunting or sports weapon according to claim 1, wherein the trigger unit is connected firmly to the receiver and connected to the pistol grip to be separable and in that the pistol grip with the magazine attached thereto forms the swivel or plug unit.

7. The hunting or sports weapon according to claim 1, wherein the horizontal swivel chamber of the swivel unit is arranged on the front part of the receiver or on the handguard.

8. The hunting or sports weapon according to claim 1, wherein the horizontal swivel chamber of the swivel unit is arranged on the front part of the buttstock or on the rear part of the receiver.

9. The hunting or sports weapon according to claim 1, wherein when the length of the barrel is 690 mm and the length of the buttstock is constant with respect to the prior art, there is a shortened total weapon length of 1.040 mm compared to a comparable weapon length according to the prior art of 1.130 mm.

10. The hunting or sports weapon according to claim 9, wherein the total weapon length of the hunting and sports weapon is shortened with respect to a hunting or sports weapon of equal dimensions by about 100 mm.

11. The hunting or sports weapon according to claim 1, wherein the breech face with the breech face line is behind the trigger and behind the trigger center line at a distance in the range between 10 to 50 mm.

12. The hunting or sports weapon according to claim 1, wherein the swivel unit has a draw-pull for insertion of the magazine.

13. The hunting or sports weapon according to claim 1, wherein the free swivelable part of the swivel unit can be connected to the weapon via a locking device.

14. The hunting or sports weapon according to claim 1, wherein a functional separation is provided between the pistol grip and the buttstock.

15. The hunting or sports weapon according to claim 1, wherein the bolt handle is arranged above and on the rear end of the pistol grip.

* * * * *